US010438521B2

(12) United States Patent
Goldrich

(10) Patent No.: US 10,438,521 B2
(45) Date of Patent: Oct. 8, 2019

(54) COLLAPSIBLE DISPLAY

(71) Applicant: Steven J. Goldrich, Portland, OR (US)

(72) Inventor: Steven J. Goldrich, Portland, OR (US)

( * ) Notice: Subject to any disclaimer, the term of this patent is extended or adjusted under 35 U.S.C. 154(b) by 326 days.

(21) Appl. No.: 15/205,718

(22) Filed: Jul. 8, 2016

(65) Prior Publication Data

US 2017/0011671 A1 Jan. 12, 2017

Related U.S. Application Data

(60) Provisional application No. 62/190,668, filed on Jul. 9, 2015.

(51) Int. Cl.
*G09F 15/00* (2006.01)

(52) U.S. Cl.
CPC ..... *G09F 15/0031* (2013.01); *G09F 15/0012* (2013.01); *G09F 15/0062* (2013.01); *G09F 2015/0093* (2013.01)

(58) Field of Classification Search
CPC ..... G09F 15/0031; G09F 15/0012; G09F 15/0062; G09F 15/0093; G09F 2013/0463; G09F 2013/0468; G09F 1/12; E04H 15/20; E04H 2015/201; E04H 2015/204; E04H 2015/206
USPC ..... 160/351, 135; 40/610, 606.01, 607.03, 40/611.01; 52/2.11, 2.18; 114/345
See application file for complete search history.

(56) References Cited

U.S. PATENT DOCUMENTS 2,191,374 A * 2/1940 Dixon ..... E04H 15/20 135/115
2,765,014 A * 10/1956 Muller ..... A47C 4/06 52/2.21
4,040,210 A * 8/1977 Land ..... E06B 7/28 160/90
5,205,086 A * 4/1993 Heim ..... E04H 15/20 135/114
5,546,707 A * 8/1996 Caruso ..... A63B 63/004 52/2.13
5,615,722 A * 4/1997 Garrett ..... A47H 2/00 160/330
6,240,666 B1 * 6/2001 Apel ..... G09F 15/0025 40/602
2014/0290104 A1 * 10/2014 Lindblom ..... G09F 15/0025 40/559
2015/0101258 A1 * 4/2015 Milo ..... E04H 15/20 52/2.18

* cited by examiner

*Primary Examiner* — Katherine W Mitchell
*Assistant Examiner* — Jeremy C Ramsey
(74) *Attorney, Agent, or Firm* — Klarquist Sparkman, LLP

(57) ABSTRACT

A display wall system is provided that has a flexible frame member with inflatable members and a plurality of panel members that can be positioned within the flexible frame member to provide rigidity to the display wall system when the inflatable members are inflated.

19 Claims, 7 Drawing Sheets

COLLAPSIBLE DISPLAY

CROSS REFERENCE TO RELATED APPLICATION

This application claims the benefit of U.S. Provisional Application No. 62/190,668, filed Jul. 9, 2015, which is herein incorporated by reference in its entirety.

FIELD

This disclosure relates to collapsible walls and wall members, and, more particularly, to collapsible, rigid inflatable displays.

BACKGROUND

Various collapsible walls and display structures have been developed. However, these conventional structures have significant drawbacks.

SUMMARY

In some embodiments, a display wall system is provided that has a flexible frame member with inflatable members and a plurality of panel members that can be positioned within the flexible frame member to provide rigidity to the display wall system when the inflatable members are inflated. The flexible frame member can have a plurality of inflatable members and a cover extending between the plurality of inflatable members. Each of the inflatable members have a deflated configuration and an inflated configuration. Panel-receiving areas are formed between the inflatable members and cover when in the deflated configuration.

The system can include a plurality of panel members that have at least two openings and a plurality of coupling devices that have at least one extending member sized to be received in respective openings of the panel members to secure at least two of the panel members together and form a plurality of coupled panels. The plurality of coupled panel members can be received in the panel-receiving areas to form a rigid support member when the inflatable members are in the inflated configuration.

The openings of the plurality of panel members can include elongated slots and the =coupling devices can include a backing panel with an elongated pin member. Panel members can be curved, straight, or any other desired shape. A graphic cover can be positioned on or over the flexible frame member.

In another embodiment, a method of assembling a display wall system is provided. The method includes coupling a plurality of panel members together to form a plurality of coupled structural members and positioning the coupled structural members into panel-receiving areas of a flexible frame member. The panel-receiving areas of the flexible frame can be located between a plurality of inflatable members and a cover coupled to the inflatable members. The inflatable members can be inflated to exert a pressure between the inflated inflatable members and cover to secure the coupled structural members to the flexible frame member.

The act of coupling the plurality of panel members together can include inserting a pin member of a backing panel into respective openings on the panel members to secure adjacent panel members together. The plurality of panel members can be curved to form a generally curved display wall system or generally straight to form a flat display wall. A graphic cover can be secured to the flexible frame member.

DETAILED DESCRIPTION

The following description is exemplary in nature and is not intended to limit the scope, applicability, or configuration of the invention in any way. Various changes to the described embodiment may be made in the function and arrangement of the elements described herein without departing from the scope of the invention.

As used in this application and in the claims, the singular forms "a," "an," and "the" include the plural forms unless the context clearly dictates otherwise. Additionally, the term "includes" means "comprises." Further, the term "associated" generally mean electrically, electromagnetically, and/or physically (e.g., mechanically or chemically) coupled or linked and does not exclude the presence of intermediate elements between the coupled or associated items absent specific contrary language.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

The compact collapsible tension fabric display is a shaped inflatable display system. The freestanding display system can be used, for example, to display graphics in a retail, trade show or advertising environment. As discussed below, high-pressure air struts are used to form a rigid element to which loose panels can be secured and reinforced to create a rigid structure.

Figure 1:
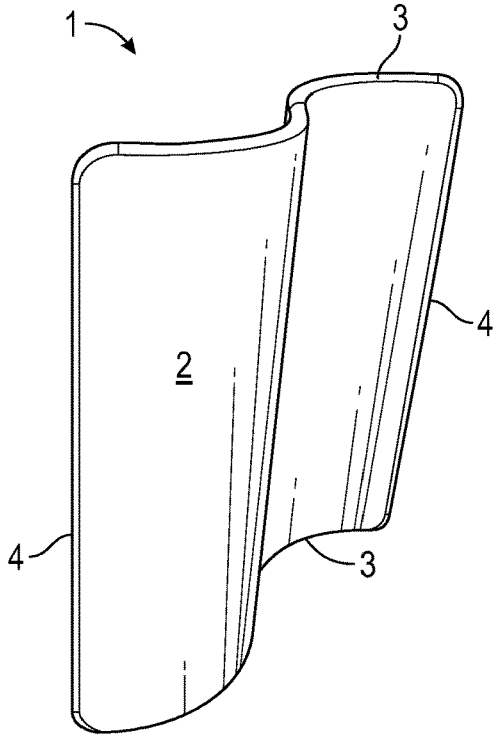
FIG. 1: Freestanding display wall.

As shown in FIG. 1, in some cases the design can be a freestanding wall (1) of varying height that utilizes a full wrapping printed graphic cover (2).

Figure 2:
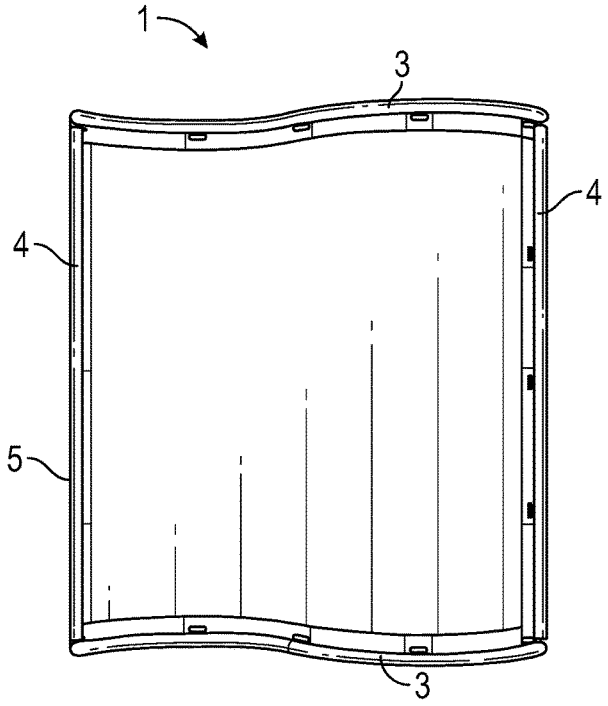
FIG. 2: Illustrates the inner frame of the display wall without printed graphic cover.

As shown in FIG. 2, consistent continuous tangential curves (3) and rigid straight vertical members (4) form an internal frame system (5), creating a drum-like cohesive interconnected structure. The tension created by the structure provides a rigidity by locking the components, including backing plates (12) and panel structural members (18) which are described in more detail herein, together in its expanded shape.

Figure 3A:
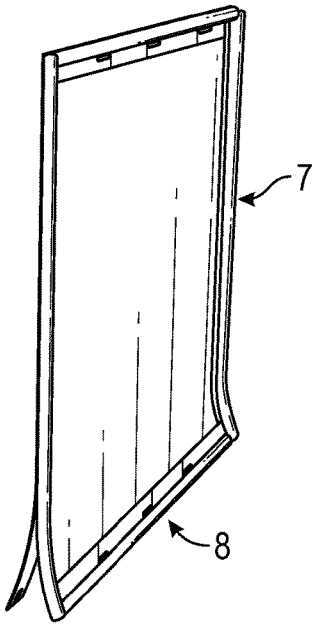
FIG. 3: Shows variations in shape of the display wall.
Figure 3B:
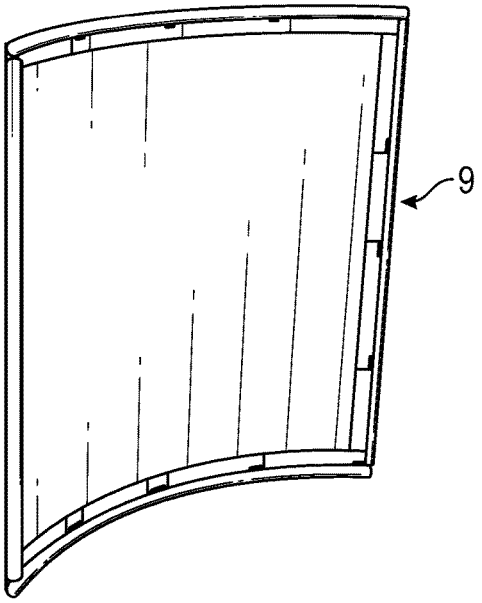

As shown in FIG. 3, additionally the design can exist in multiple configurations including straight walls (7) with enlarged base (8) as well as curved, conical and abstract wall shapes (9).

Figure 4:
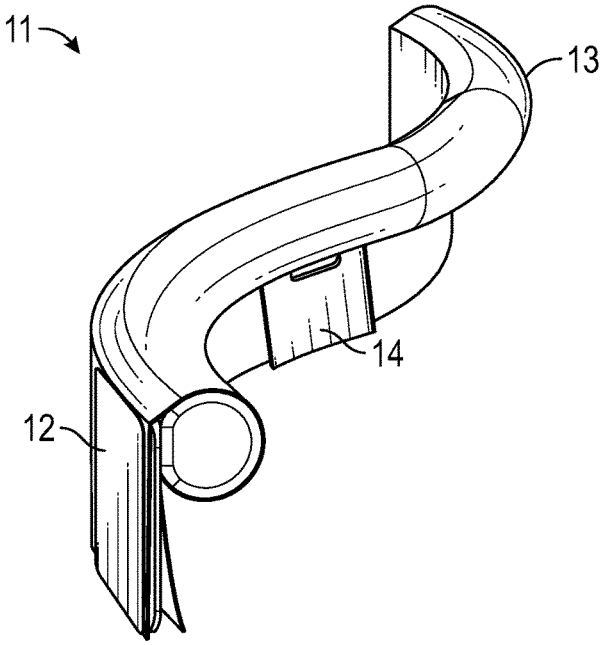
FIG. 4: Wall portion with cross section.

As shown in FIG. 4, wall sections (11) can include a backing plate (12) secured to a fabric cover enclosure with flexible lashings (14) to secure the internal components. The flexible lashings can be formed of any material suitable for securing the components together. Preferably, the lashings can be easily and quickly secured and removed to allow easy setup and takedown, such as by using VELCRO® lashings.

Figure 5:
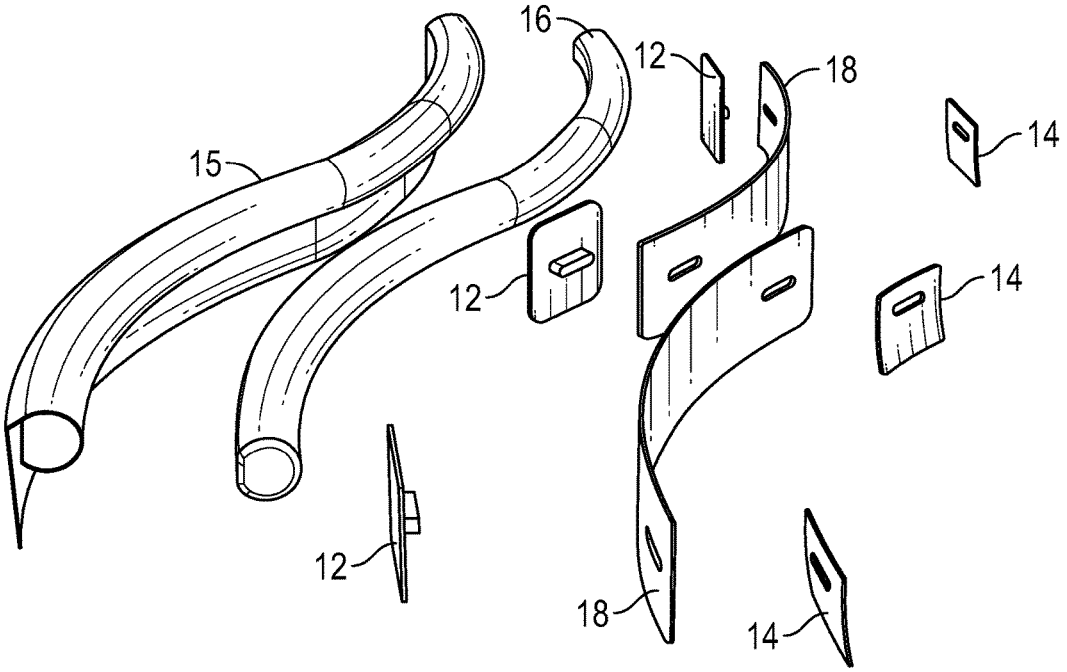
FIG. 5: Exploded view of a wall portion illustrating basic components.

As shown in FIGS. 3 and 5, a flexible fabric frame is formed by the cover (15) and a plurality of inner pneumatic bladders (16) located at each side of the cover. The backing plate (12) is shown as well as the panel structural members (18). At least some of the panel structural members can have the same shape (curved and/or straight), allowing for convenient packaging and assembly.

Figure 6:
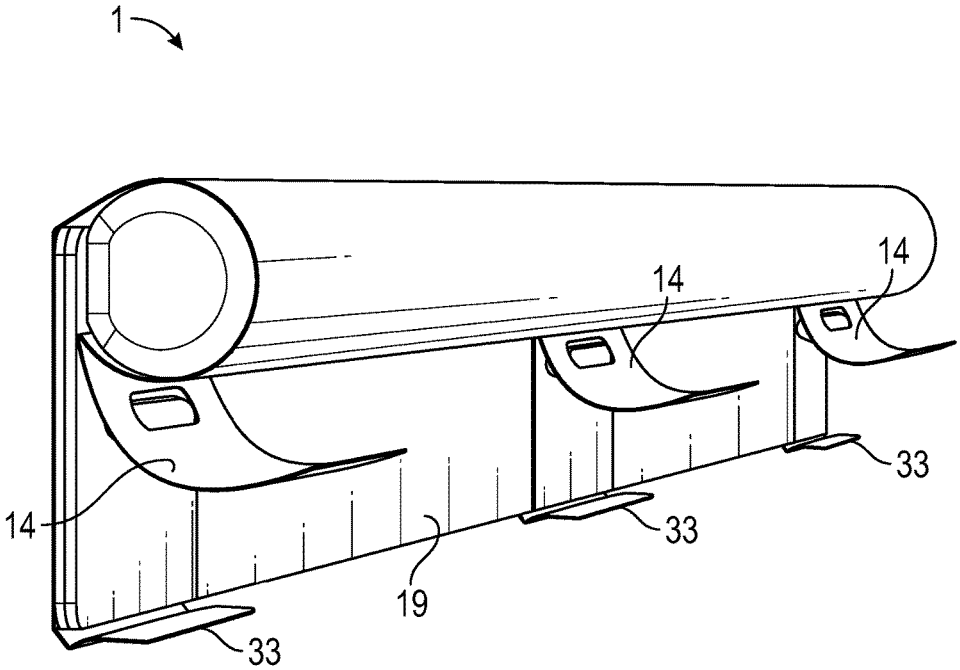
FIG. 6: Wall portion showing open fasteners.

As shown in FIG. 6, panels (19) and lashings overlap at junctions to secure and form a rigid structure. Thus, once inflated, the bladders form an inflatable strut that provides a stabilizing force against the panel structure members (18) and creates a tensioned smooth surface for a graphic cover with a smooth, low-profile non-protruding back face. Graphic cover can be formed of any suitable flexible material that can receive graphics on the material, or that can be used to support another material that can display graphics or other visual information. In one embodiment, the graphic cover can comprise an aluminum composite material with a graphic contained thereon, such as pre-painted sheets of aluminum with a flexible polyethylene core.

Figure 7:
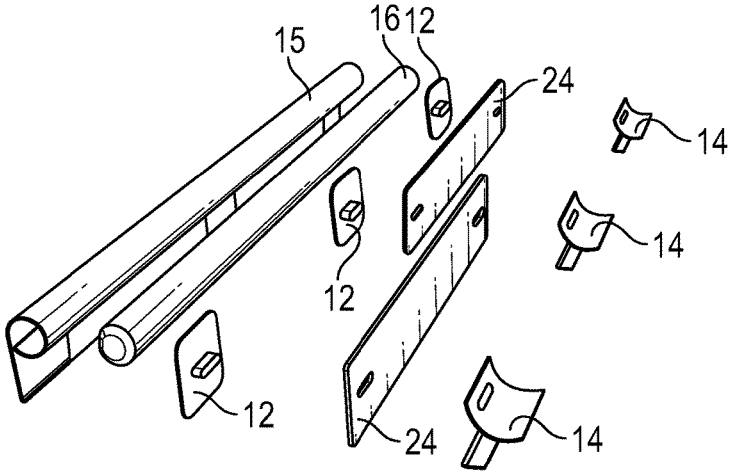
FIG. 7: Alternate exploded view of wall section components.

As shown in FIG. 7, as well as curved components, straight variable length components (24) are also possible with varying connection locations.

Figure 8:
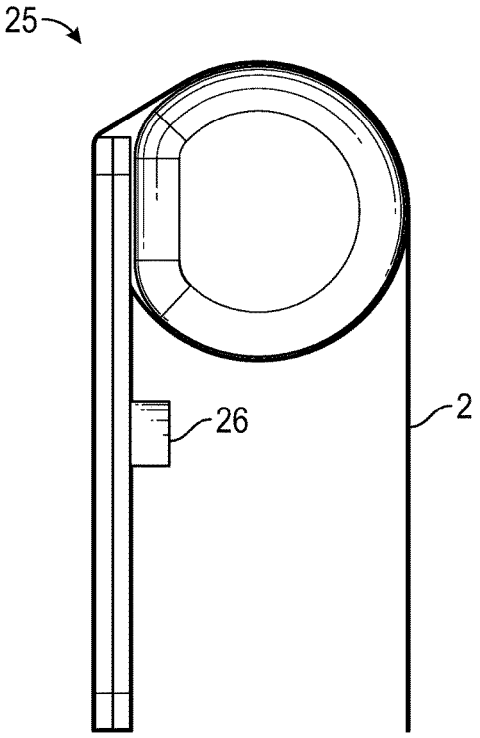
FIG. 8: Shows detail of wall member with cross section and printed graphic cover.

As shown in FIG. 8, the panels form a locked lap joint (25) secured from rotation by a linear tenon pin (26). A tensioned inflatable cover (2), forming a smooth front graphic display surface, provides reinforcement. The inflated volume creates a raised member creating a reduced visual distraction, anomalies and surface irregularities. Graphic surface irregularity draws the eye and produces a sub-par graphic display surface.

Figure 9:
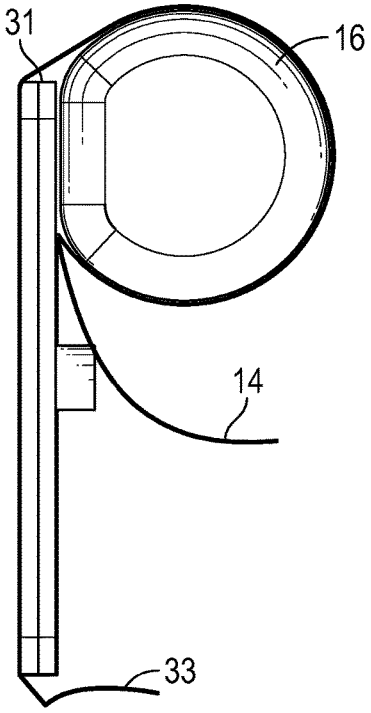
FIG. 9: Shows detail of wall member with cross section and open fasteners.

As shown in FIG. 9, the high-pressure pneumatic vessel (16) keeps the graphic elevated above the panels edges (31) while containment straps (14) and associated fasteners (33) are concealed under the protruding feature. These features render the components invisible through the graphic cover.

Figure 10:
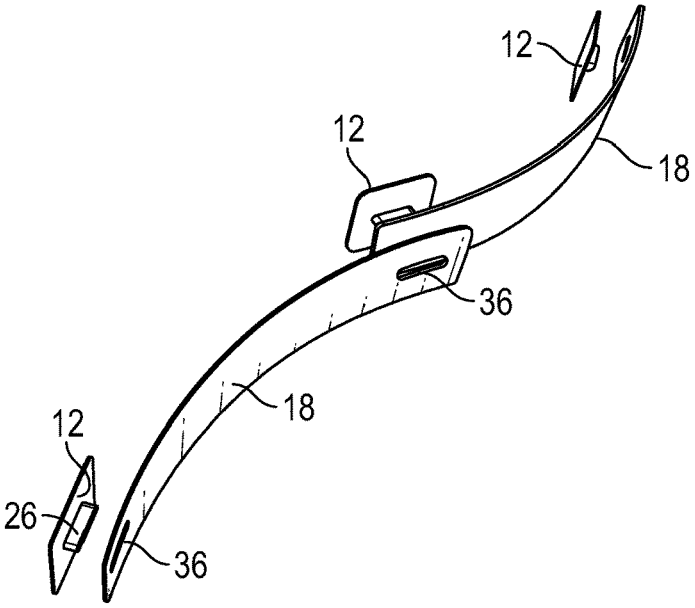
FIG. 10: Exploded view of a curved panel assembly.

As shown in FIG. 10, a panel assembly (18) (shown without an inflated member) is held together by a basic backing plate (12) with a linear type tenon pin (26) that corresponds to a linear slot (36) in a corresponding panel. Backing plates and pins can be formed from any suitable material. In one embodiment, the backing plate is formed a generally rigid and lightweight plastic material such as ABS, and the pin can be an aluminum pin riveted in place to the backing plate. In other embodiments, the backing plate and pin can be integrally formed of the same material.

Figure 11:
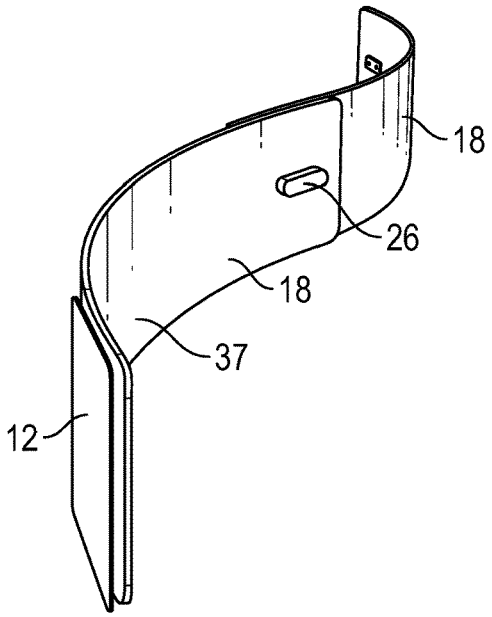
FIG. 11: Panel assembly portion.

As shown in FIG. 11, a complete inner panel frame structure is achieved by these two main components (18).

Figure 12:
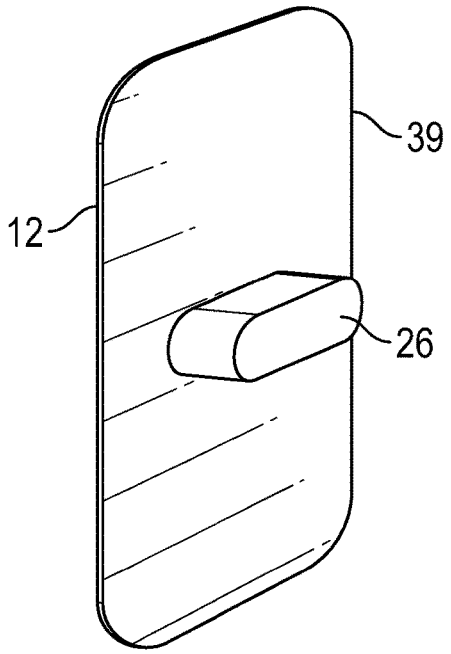
FIG. 12: Assembled backing plate.

As shown in FIG. 12, a typical backing plate assembly (12) has a flat flange (39) to prevent the linear tenon pin (26) from slipping through the corresponding slot in the panel components.

Figure 13:
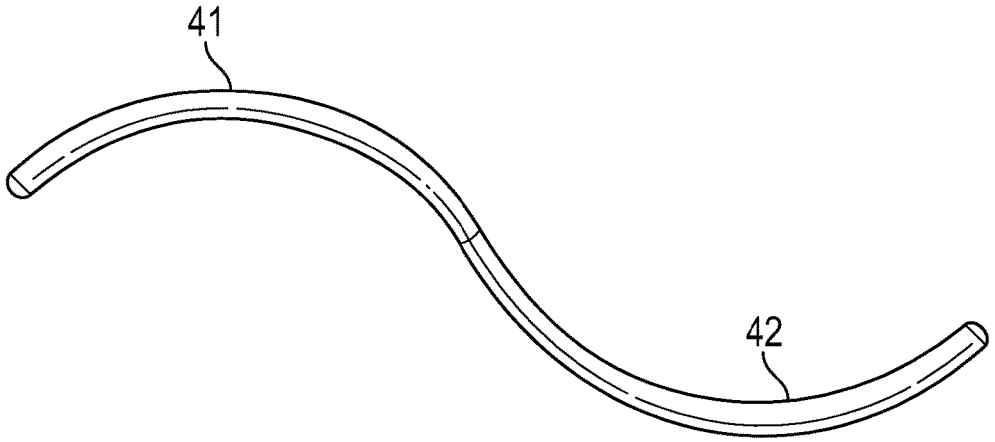
FIG. 13: Top view of a wall portion.

As shown in FIG. 13, a typical top-view illustration, illustrates a smooth consistent graphic surface and low-profile cross-section, with the minimal amount of panel edge showing through the printed graphic cover in the rear (42).

Figure 14:
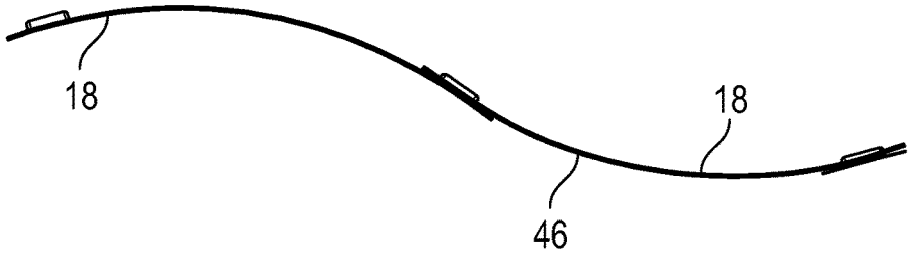
FIG. 14: Top view of a panel assembly portion.

As shown in FIG. 14, a top view of a panel assembly without an inflated member, illustrates an asymmetrical assembly (18), minimal cross-section and smooth continuous tangent curve (46).

Figure 15:
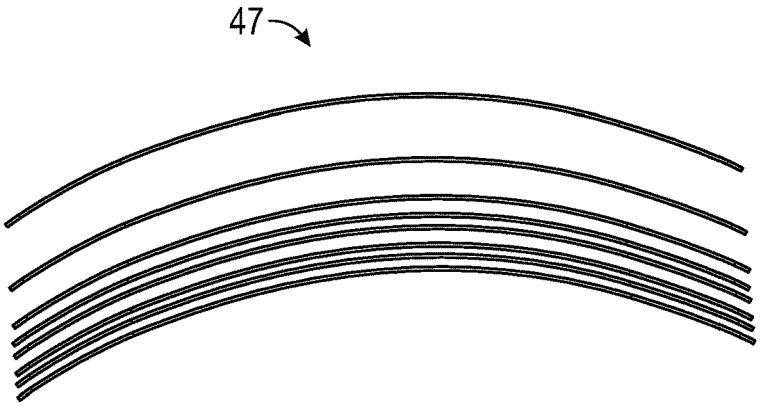
FIG. 15: Stacked panels.

As shown in FIG. 15, intended to be stored in a compact manner components are designed to nest or stack together to form a compacted final form factor (47).

Figure 16:
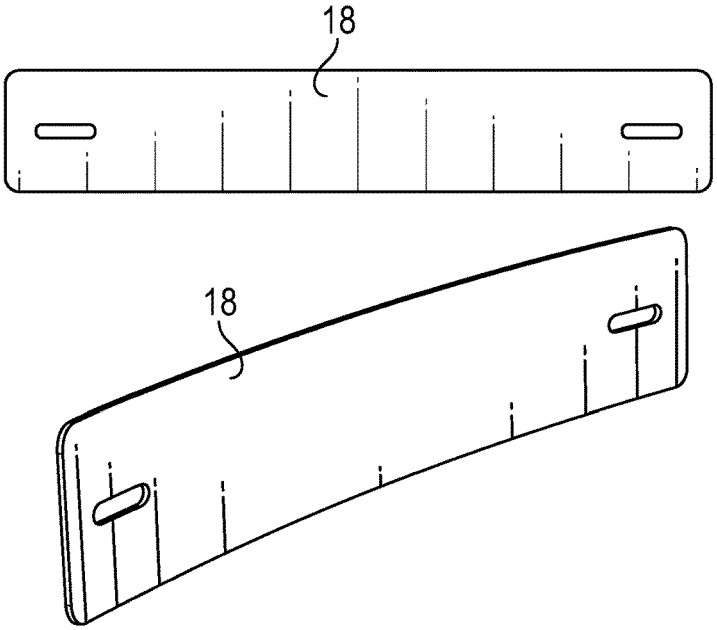
FIG. 16: Basic panel design.

As shown in FIG. 16, panel components are symmetrical and ambidextrous with universal and reversible features. The panels (18) shown in FIG. 16 illustrate the lightweight, rigid, shaped, inflatable, and collapsible display system.

To assemble the display wall, a plurality of panels are coupled together by the backing plates with pins, such that adjacent panels overlap with one another. As best shown in FIGS. 8 and 9, the coupled panels are inserted into the flexible frame between the bladder and the cover on each side of the display wall. The bladders are then inflated to secure the panels into position between the bladders and the cover, with the locking panels substantially reducing vertical deflection under load. Thus, when all the bladders are inflated, and all the coupled panels secured to the flexible frame by the inflation pressure of the bladders, the panels and flexible frame create a stable structure onto which a graphic cover can be positioned. Graphic cover can be applied to the system in any known manner. In one embodiment, graphic cover can be a casing with an opening that can be secured over the structure. If desired, a closure can be provided at the opening of the graphic cover, such as a zipper or other closure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A display wall system comprising:

a flexible frame member having a plurality of inflatable members and a cover extending around a perimeter of the plurality of inflatable members, each of the inflatable members has a deflated configuration and an inflated configuration;

a plurality of panel-receiving areas adjacent the inflatable member and cover;

a plurality of panel members, each member having at least two openings; and a plurality of coupling devices each having at least one extending member received in a respective opening of each of the panel members to secure at least two of the panel members together and form a plurality of coupled panel members;

wherein the plurality of coupled panel members are configured to be secured to the flexible frame member in the panel-receiving areas to form a rigid support member when the inflatable members are in the inflated configuration.

2. The display wall system of claim 1, wherein the openings of the plurality of panel members comprise elongated slots.

3. The display wall system of claim 2, wherein the coupling devices each comprise a backing panel with an elongated pin member forming the extending member.

4. The display wall system of claim 1, wherein at least some of the plurality of panel members are curved.

5. The display wall system of claim 1, wherein at least some of the plurality of panel members are flat.

6. The display wall system of claim 1, further comprising a graphic cover comprising an opening, the opening being sized to receive the flexible frame member within the graphic cover.

7. The display wall system of claim 1, wherein the panel members are at least three times as long as they are wide.

8. The display wall system of claim 1, wherein the plurality of inflatable members are independently inflatable.

9. The display wall system of claim 1, wherein the plurality of inflatable members can be inflated together.

10. The display wall system of claim 1, wherein the plurality of coupled panel members are secured to the flexible frame member with one or more hook and loop lashings.

11. A method of assembling the display wall system of claim 1, the method comprising:

Coupling the plurality of panel members together to forma plurality of coupled structural members;

positioning the coupled panel members into the panel-receiving areas of the flexible frame member, the panel-receiving areas of the flexible frame being located adjacent the plurality of inflatable members and the cover coupled to the inflatable members; and inflating the inflatable members to exert a pressure between the inflated inflatable members and cover to secure the coupled panel members to the flexible frame member.

12. The method of claim 11, wherein the plurality of coupling devices are a plurality of backing panels and the act of coupling the plurality of panel members together comprises inserting a pin member of a respective backing panel into a respective opening of a panel member to secure adjacent panel members together.

13. The method of claim 11, wherein at least some of the plurality of panel members are curved to form a generally curved display wall system.

14. The method of claim 11, wherein at least some of the plurality of panel members are flat to form a generally flat display wall system.

15. The method of claim 11, further comprising securing a graphic cover to the flexible frame member.

16. The method of claim 15, wherein the graphic cover comprises an opening and the flexible frame member is inserted into the opening of the graphic cover to cover the flexible frame member with the graphic cover.

17. The method of claim 11, wherein the inflatable members are independently inflatable.

18. The method of claim 11, wherein the inflatable members are in fluid connection with one another and can be inflated through one air-receiving area.

19. The method of claim 11, wherein positioning the coupled panel members into the panel-receiving areas of the flexible frame member comprises securing the coupled panel members to the flexible frame member with hook and loop lashings.

* * * * *